US007707999B2

(12) United States Patent
Inoue

(10) Patent No.: US 7,707,999 B2
(45) Date of Patent: May 4, 2010

(54) EXHAUST PROTECTING DEVICE AND PROTECTING METHOD FOR INTERNAL COMBUSTION ENGINE

(75) Inventor: Toshiaki Inoue, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 488 days.

(21) Appl. No.: 11/879,605

(22) Filed: Jul. 18, 2007

(65) Prior Publication Data

US 2008/0027626 A1 Jan. 31, 2008

(30) Foreign Application Priority Data

Jul. 25, 2006 (JP) ..... 2006-202205
Jul. 2, 2007 (JP) ..... 2007-174134

(51) Int. Cl.
*F02D 41/00* (2006.01)
*F02D 1/00* (2006.01)

(52) U.S. Cl. ..... 123/672; 123/676

(58) Field of Classification Search ..... 123/434, 123/435, 672, 676
See application file for complete search history.

(56) References Cited

U.S. PATENT DOCUMENTS 6,050,086 A * 4/2000 Ishizuka et al. ..... 60/274
6,612,292 B2 * 9/2003 Shirakawa ..... 123/501
6,718,960 B2 * 4/2004 Someno et al. ..... 123/704
6,915,776 B2 * 7/2005 zur Loye et al. ..... 123/304
7,131,408 B2 * 11/2006 Baeuerle ..... 123/90.15
2002/0124828 A1 * 9/2002 Shirakawa ..... 123/299
2003/0131593 A1 * 7/2003 Asanuma ..... 60/297
2004/0006986 A1 * 1/2004 Baeuerle ..... 60/601

FOREIGN PATENT DOCUMENTS

JP 63-045444 2/1988
JP 2004-0177179 6/2004

OTHER PUBLICATIONS

English Abstract for JP-2004-0177179, Jun. 24, 2004.
English Abstract for JP 63-045444, Feb. 26, 1988.

* cited by examiner

*Primary Examiner*—John T Kwon
(74) *Attorney, Agent, or Firm*—Global IP Counselors, LLP

(57) ABSTRACT

Fuel efficient devices and methods for protecting an exhaust system, and components thereof, when the exhaust gas temperature increases excessively are provided. The exhaust gas temperature is estimated in response to an internal resistance of an Air/Fuel ratio sensor element. The estimated temperature is corrected in a transition time based on the exhaust gas flow rate and the engine's operating region. When the exhaust gas temperature reaches an upper limit (Tmax), a delay period is set in response to the change ratio of the exhaust gas temperature. The delay period is based on the margin of time before an exhaust system component reaches the allowable heat resistance temperature Tem. The delay period can be corrected based on the outside air temperature and the vehicle speed. After the delay time has elapsed, a fuel increment is started in order to decrease the exhaust temperature.

16 Claims, 6 Drawing Sheets

EXHAUST PROTECTING DEVICE AND PROTECTING METHOD FOR INTERNAL COMBUSTION ENGINE

CROSS-REFERENCE TO RELATED APPLICATION

The present application claims priority to Japanese Patent Application No. 2006-202205 and Japanese Patent Application No. 2007-174134, the contents of which are incorporated herein in their entirety.

TECHNICAL FIELD

The disclosed devices and methods relate to protecting an internal combustion engine exhaust system, and more particularly to protecting exhaust system components including, among other components, the exhaust manifold.

BACKGROUND

Japanese Patent Application Laid-Open (JP-A) No. 63-045444 discloses that the exhaust gas temperature can be detected in order to protect an exhaust system component. Specifically, when the temperature increases excessively, the fuel feed rate is increased and corrected to decrease the exhaust gas temperature.

JP-A 2004-177179 discloses that an internal resistance (impedance) of a sensor element of an air/fuel (A/F) ratio sensor (oxygen sensor) arranged in an exhaust system can be measured and used to estimate the temperature of the exhaust gas.

In both JP-A 63-045444 and JP-A 2004-177179, the fuel feed rate is increased when the exhaust gas temperature reaches a predetermined temperature. However, the temperature increase of the exhaust manifold or other similar elements that have a large heat capacity lags behind the increase in the exhaust gas temperature. Increasing the fuel feed rate immediately after the exhaust gas temperature reaches a exhaust system components occurs and can therefore reduce the fuel efficiency of the engine.

SUMMARY

The exemplary teachings of this disclosure address the above-described problems, and recognize that it is desirable to protect the exhaust system by performing a fuel increment without also deteriorating the fuel efficiency.

Thus, exemplary teachings related to exhaust system protection devices and methods follow. When an estimated value of the exhaust gas temperature reaches a predetermined temperature, a fuel increment is delayed for a calculated period of time. The calculated delay period is based on the change ratio of the exhaust gas temperature. The fuel increment proceeds at the conclusion of the delay period.

Setting the delay period of a fuel increment as described above enables the fuel increment to be implemented with consideration of the actual temperature increase of an exhaust system component which is to be protected. Accordingly, the exhaust system component can be protected while minimizing any deterioration in fuel efficiency.

BRIEF DESCRIPTION OF THE DRAWINGS

While the claims are not limited to the illustrated embodiments, an appreciation of various aspects of the system is best gained through a discussion of various examples thereof.

Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows.

DETAILED DESCRIPTION

Figure 1:
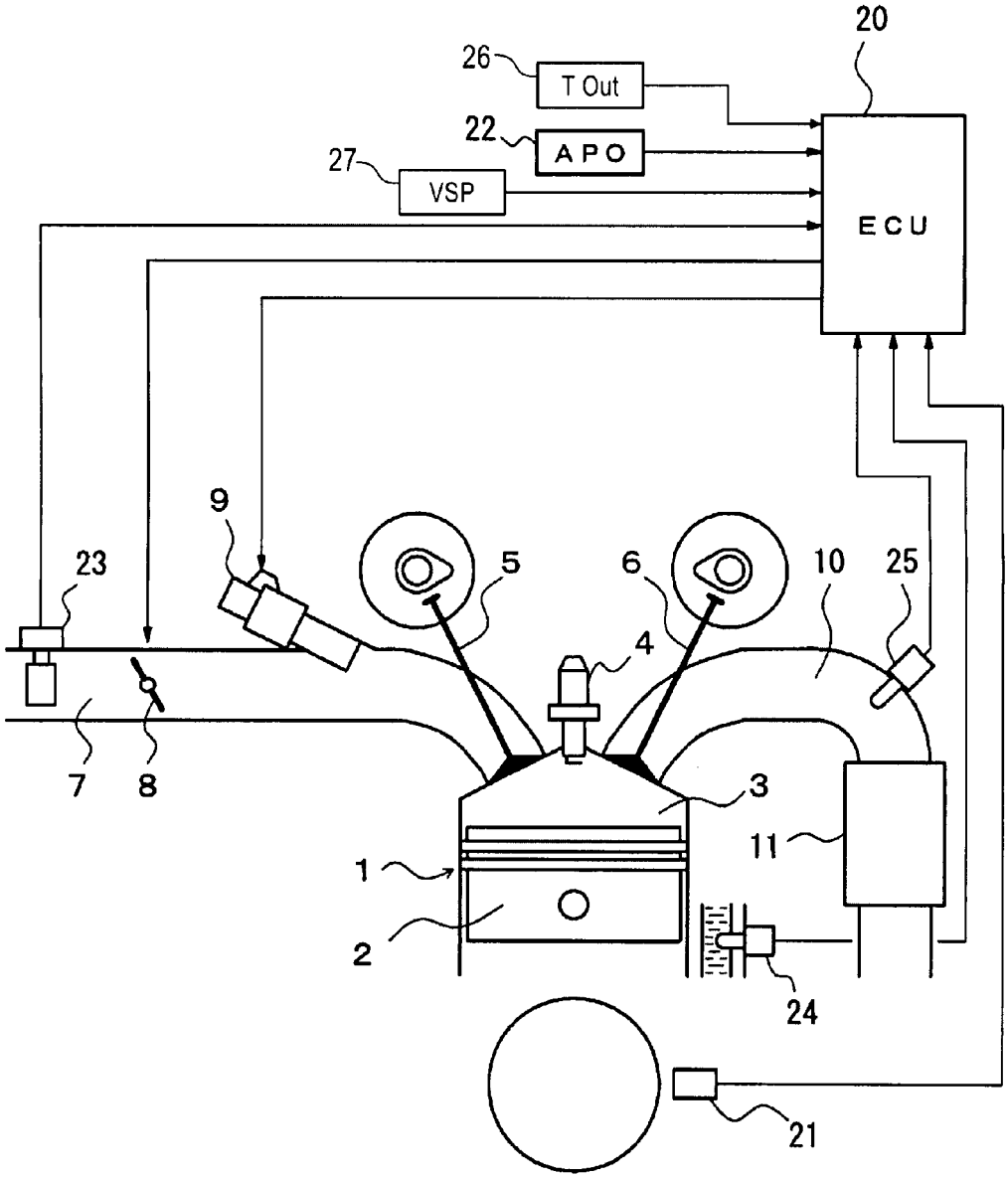
FIG. 1 is a system diagram of an engine and exhaust system showing one embodiment.

FIG. 1 is a system diagram of an internal combustion engine and exhaust system. An engine cylinder shown generally in FIG. 1 includes a combustion chamber 3, a piston 2, and an intake valve 5 and an exhaust valve 6 surrounding an ignition plug 4.

Intake path 7 includes an electrically controlled throttle valve 8 upstream of an intake manifold. The intake path 7 further includes an electromagnetic fuel injection valve 9, facing an intake port of a cylinder head, within each branch of the intake manifold that allows for the injection of fuel having a predetermined pressure to the valve head of intake valve 5. However, a direct injection type fuel injection valve may be employed instead.

An exhaust gas purification catalyst 11 is provided downstream of the exhaust manifold within a gathering part of the exhaust gas path 10.

The operations of the electrically controlled throttle valve 8 and the fuel injection valve 9 are controlled by an engine control unit (hereinafter referred to as ECU) 20. The ECU 20 receives input signals from at least a crank angle sensor 21, an accelerator pedal opening sensor 22, an air flow meter 23, a water temperature sensor 24, an air-to-fuel (hereinafter referred to as A/F) ratio sensor (oxygen sensor) 25. The crank angle sensor 21 can output a crank angle signal in synchronization with the engine rotation to detect the crank angle position and the engine rotational speed Ne. The accelerator pedal opening sensor 22 detects the depression amount (accelerator pedal opening) APO of the accelerator pedal. The air flow meter 23 detects the intake air amount Qa within the intake path 7 upstream of the electrically controlled throttle valve 8. The water temperature sensor 24 detects an engine coolant temperature Tw. The A/F ratio sensor (oxygen sensor) 25 detects the air-to-fuel ratio of exhaust gas upstream of the catalyst 11 of the exhaust gas path 10. The outside air-temperature sensor 26 detects the outside temperature of the vehicle. The vehicle speed sensor 27 detects the vehicle speed. The ECU 20 controls the opening of the electrically controlled throttle valve 8 in response mainly to the accelerator pedal opening APO to control the intake air amount.

Further, the ECU 20 calculates a standard fuel injection amount Tp=K·Qa/Ne (K is a constant number) from the intake air amount Qa and the engine rotational speed Ne. This standard amount Tp is then adjusted using an A/F ratio feedback correction coefficient α and various correction coefficients COEF to calculate a final fuel injection amount Ti=Tp·α·COEF. The ECU 20 outputs a fuel injection pulse with a pulse width corresponding to the Ti to the fuel injection valve 9 of each cylinder in synchronization with the engine rotation to control the fuel injection amount.

The A/F ratio feedback correction coefficient α stoichiometrically controls the A/F ratio in response to the output of the A/F ratio sensor 25 (real A/F ratio). The real A/F ratio and an objective A/F ratio (stoichiometric value) are compared under an A/F ratio feedback control condition to set increments/decrements of α through proportional integration control (reference value is 1).

At least a fuel increment correction coefficient Kfuel is included in various correction coefficients COEF (COEF=1+ . . . +Kfuel). The fuel increment correction coefficient Kfuel is 0 during normal operation. When the exhaust gas temperature increases excessively, Kfuel is set to a value greater than zero after the A/F ratio feedback control is stopped (α is fixed to the reference value or a previous value) to increase the fuel injection amount, so that the A/F ratio can be enriched. The Kfuel value may be increased as the operating conditions of the engine proceed to a greater load and a higher rotational speed.

Figure 2:
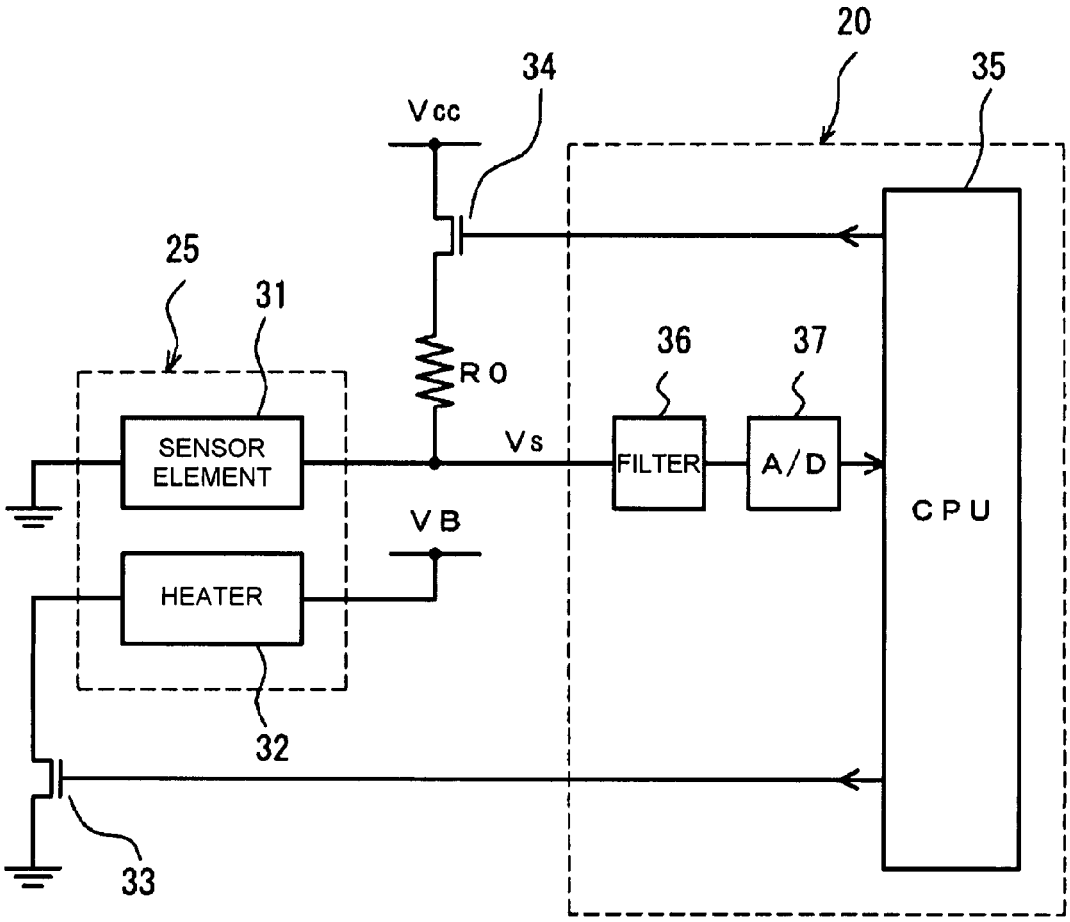
FIG. 2 is a control circuit diagram for an Air-to-Fuel (A/F) ratio sensor.

FIG. 2 is a control circuit diagram for the A/F ratio sensor 25, which includes a sensor element 31 and a heater 32 for heating the sensor element. The heater 32 is arranged adjacent to the sensor element 31 of the A/F ratio sensor 25. The heater 32 heats the sensor element 31 anytime it is cold due to inactivity. The heater is operated by appling a battery voltage VB through a switching element 33.

The output voltage Vs of the sensor element 31 of the A/F ratio sensor 25 changes linearly in response to the A/F ratio. A predetermined voltage Vcc (for example, 5 V) for measuring the internal resistance is applied to the sensor element 31 through a switching element 34 and a reference resistance R0. Therefore, when the switching element 34 is turned ON, the voltage for measuring the internal resistance is raised on the output Vs of the sensor element 31.

A central processing unit (CPU) 35 in the ECU 20 turns the switching element 33 ON anytime the sensor is cold to heat the sensor element 31 by the heater 32. Further, while setting the ON/OFF state of the switching element 34, which applies an internal resistance measuring voltage Vcc, CPU 35 reads the output Vs of the sensor element 31 through a filter (smoothing circuit) 36 and an A/D converter 37 at a predetermined timing. The sensor output Vs is read while the switching element 34 is in an OFF state, so that the A/F ratio can be detected in response to the value. The sensor output Vs is read while the switching element 34 is in an ON state, so that the internal resistance of the sensor element 31 can be measured in response to the value. The exhaust gas temperature (element temperature) can be estimated based on the measurement.

Figure 3:
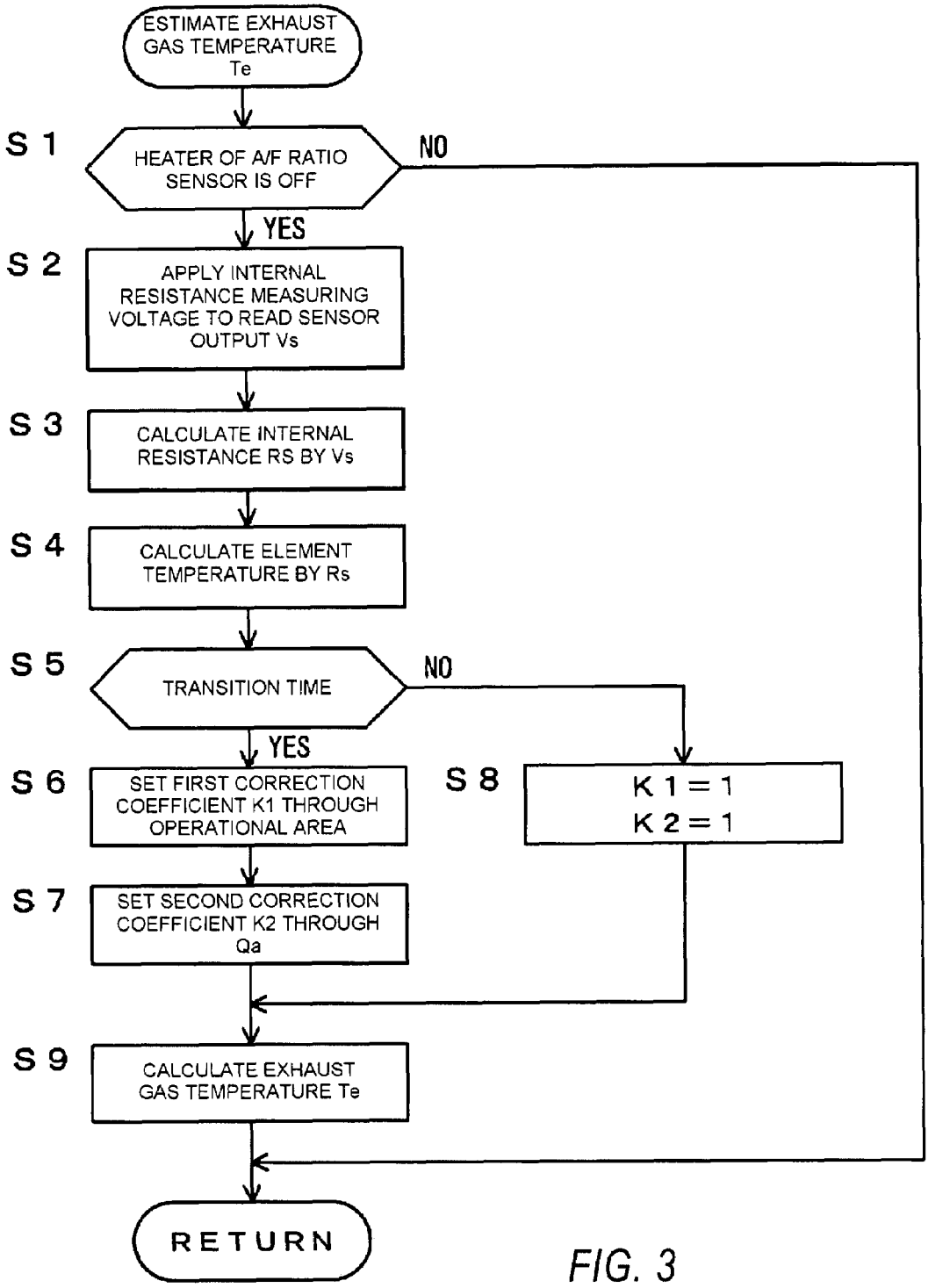
FIG. 3 is a flow chart of an exhaust gas temperature estimation routine.

FIG. 3 is a flow chart of an exhaust gas temperature estimation routine by the ECU. This routine exemplifies one possible exhaust gas temperature estimation mechanism or means. In S1, it is determined whether the heater 32 of the A/F ratio sensor 25 is in the OFF condition or not. Recognizing that the heater is forcibly turned OFF whenever possible, the process proceeds to S2 only when the heater is in the off condition. In S2, the switching element 34 is turned ON in order to measure the internal resistance of the sensor element 31. Thus, the internal resistance measuring voltage Vcc is applied to the sensor element 31, and in this state, the sensor output Vs is read. The sensor output Vs read at this time may include an error due to a varying voltage in response to the A/F ratio. In order to correct any error, a correction can be performed while Vs=Vs−Vs' where Vs' is a sensor output at A/F ratio detection timing immediately before the internal resistance measuring voltage is applied. Detection of the A/F ratio is prohibited when the internal resistance is measured, while likewise measurement of the internal resistance is prohibited when the A/F ratio is detected.

In S3, an internal resistance Rs of the sensor element 31 is calculated in response to the sensor output Vs, which has been read and possibly corrected. Specifically, assuming that a current flowing in the sensor element 31 is i, the following formulas are obtained:

$$Vs=i\times Rs$$

$$Vcc-Vs=i\times R0$$

Obtaining Rs=Vs/[(Vcc−Vs)/R0]. Thus, the internal resistance Rs can be calculated.

In S4, an element temperature Ts is calculated by using the internal resistance Rs of the sensor element 31 with reference to a table and the like. The element temperature Ts is related to the internal resistance Rs in that the greater the Ts value, the smaller the Rs value. As a result of this known relationship, the element temperature Ts can be calculated by using the internal resistance Rs.

In S5, it is determined whether or not the internal combustion engine driving condition is a transition condition. Despite the fact that the exhaust gas temperature can be estimated with higher accuracy during normal engine operation when it is estimated through the element temperature (internal resistance), a correction is needed at a transition time due to a time lag that is generated as a result of heat mass of the sensor element part at a transition time. A plurality of factors such as whether the vehicle is accelerating, a change of the engine's operational region (the combination of the rotational speed and the load), and a change in the element temperature (internal resistance) determine whether the engine driving condition is a transition condition. If the internal combustion engine condition is a transition condition, the process proceeds to S6 and S7.

In S6, a first correction coefficient K1 is calculated based on the operational region as defined by the engine rotational speed and the load (fuel injection amount and the like) with reference to a map. K1 is mapped to a value of 1 (no correction) in a lower rotational speed and lower load region, and to K1>1 in a higher rotational speed and higher load region. This correction is required because the higher rotational speed and greater load result in an over estimate of the exhaust gas temperature Te under a transition condition.

In S7, a second correction coefficient K2 is calculated based on the exhaust gas flow rate, which is determined from the intake air amount Qa and a reference table. This table lists values of K2=1 (no correction) for a lower exhaust gas flow rate (Qa), while providing values of K2>1 for a higher exhaust gas flow rate (Qa). This correction is required because higher exhaust gas flow rates (Qa) result in an over estimate of the exhaust gas temperature Te under a transition condition. It is possible that the calculation of either K1 or K2, or both, occurs during the routine in order to correct the estimated exhaust gas temperature Te.

If the internal combustion engine driving condition is not a transition condition (i.e. in the case of normal operation), the process proceeds to S8. In S8, the correction coefficients K1 and K2 are both set to 1 indicating that no correction is needed. Alternatively, they may be set to a value, which is smaller than the value under a transition condition. Thereafter, the process proceeds to S9. In S9, the exhaust gas temperature Te is set to the product of the element temperature (exhaust gas temperature standard value) Ts, the first correction coefficient K1, and second correction coefficients K2 (Te=Ts*K1*K2).

Figure 4:
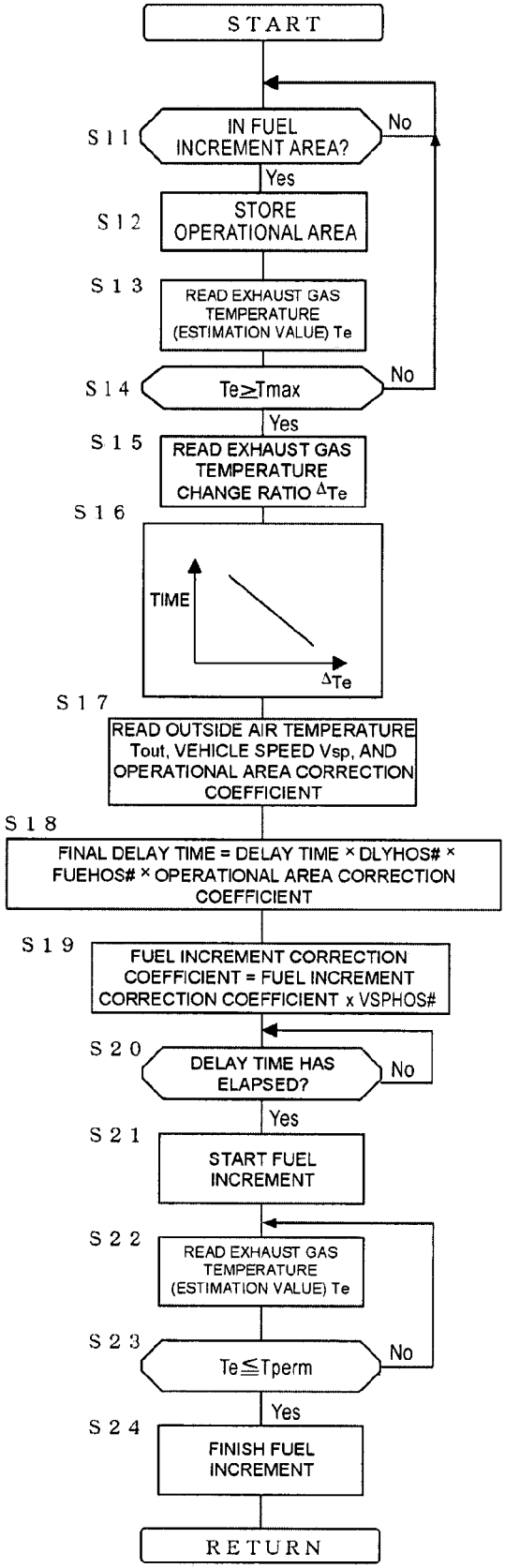
FIG. 4 is a flow chart of a fuel increment control routine.

FIG. 4 presents a flow chart depicting the steps of one possible fuel increment control routine executed by an ECU. In S11, the operating region of the vehicle, as determined by the rotational speed and load of the engine, is analyzed to determine whether a fuel increment is required. Specifically, high rotational speeds and high loads would indicate that a fuel increment is required. If the engine is not operating in a region that requires a fuel increment, the present routine is finished leaving the state as is. However, when the operating region requires a fuel increment the process proceeds to S12.

Figure 6:
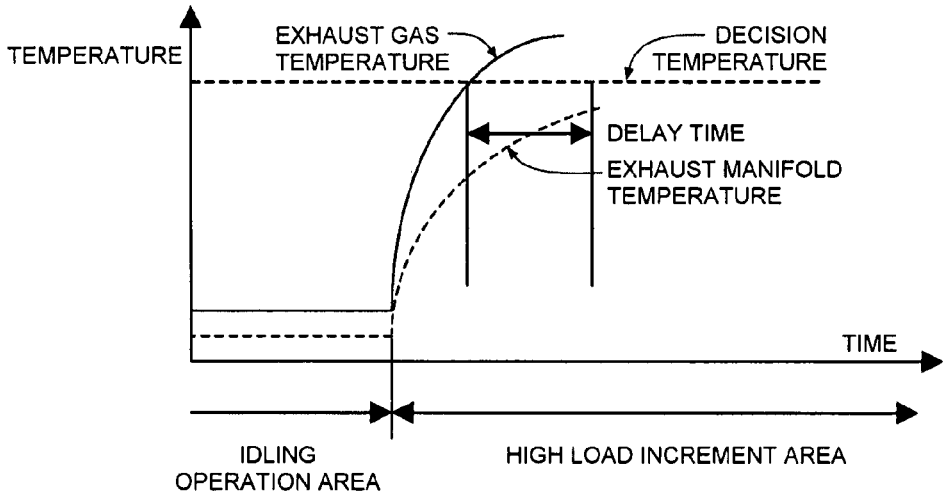
FIG. 6 is a timing chart showing the exhaust gas temperature and the temperature of an exhaust manifold at the time when idling proceeds to a fuel increment stage.
Figure 7:
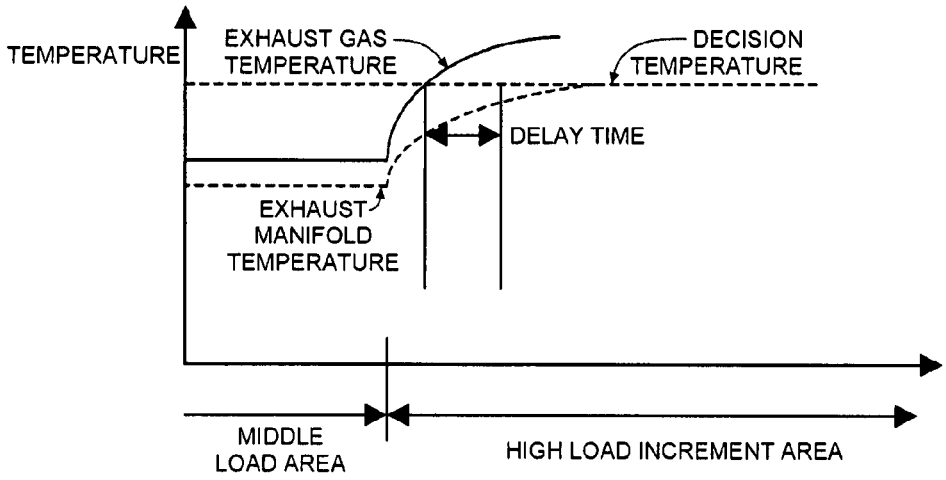
FIG. 7 is a timing chart showing the exhaust gas temperature and the temperature of the exhaust manifold at the time when a middle load proceeds to the fuel increment stage.

In S12, the operational region is stored immediately prior to a required fuel increment. Storage of the region is necessary because the ability of exhaust system components to tolerate a change in the exhaust gas temperature varies depending on the preceding operational region as shown in FIGS. 6 and 7. More specifically, FIG. 6 shows a case in which the engine is idling prior to transitioning to a high load that necessitates a fuel increment. While idling, both the exhaust gas temperature and the temperature of the exhaust manifold are low. For this reason, even if the exhaust gas temperature reaches Tmax when the operational state transitions to a high load that necessitates a fuel increment, the amount of time that can elapse before the exhaust manifold reaches its maximum allowable temperature is longer than it would be had the engine been operating in excess of its idle speed and load.

FIG. 7 shows a case in which the engine is operating in a middle load region prior to transitioning to a high load region that necessitates a fuel increment. In the middle load operational region, both the exhaust gas temperature and the temperature of the exhaust manifold are high. For this reason, the amount of time that can elapse before the exhaust gas reaches a first predetermined temperature Tmax is shorter than the case of FIG. 6. Similarly, the amount of time that can elapse before the exhaust manifold reaches its maximum allowable temperature also becomes shorter than the case of FIG. 6. So in summary, the operating region immediately preceding a fuel increment is stored at S12 due to the fact that the delay imposed before a fuel increment varies with respect to the engine's operating region prior to a fuel increment.

Returning to FIG. 4, next in S13, the exhaust gas temperature Te, is estimated and stored according to the previously described exhaust gas temperature estimation routine of FIG. 3. Then, in S14, the exhaust gas temperature Te is compared with the first predetermined temperature Tmax to determine whether Te≧Tmax. The predetermined temperature Tmax is a temperature at which the exhaust manifold reaches the allowable heat resistance. So, when the exhaust gas temperature exceeds the first predetermined temperature Tmax, a fuel increment is necessary because there is a possibility that the temperature of the exhaust manifold will exceed the maximum allowable heat resistance temperature. The first predetermined temperature Tmax is a comparison value used to identify such a situation. If Te≧Tmax as a result of the determination, the process proceeds to S15. In S15, an exhaust gas temperature change ratio ΔTe is calculated by obtaining the difference between a current time exhaust gas temperature and the Te that was stored in S13.

Figure 5:
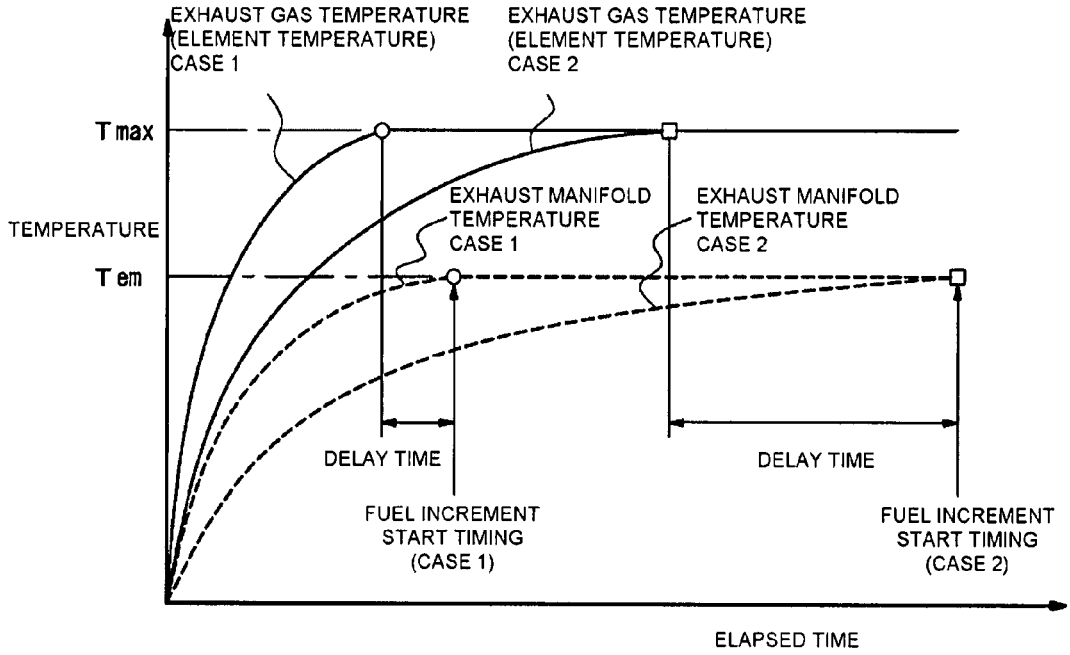
FIG. 5 is a timing chart of exhaust gas temperature estimation and fuel increment control.

In S16 the delay time until a fuel increment is calculated using the exhaust gas temperature change ratio ΔTe with reference to a predetermined table. Specifically, longer delay times are set for smaller exhaust gas temperature change ratio ΔTe values. Likewise, shorter delay times are set for larger exhaust gas temperature change ratio ΔTe values. Consequently, as shown in FIG. 5, the delay time is set such that a fuel increment begins when the temperature of the exhaust manifold which is to be protected reaches the allowable heat resistance temperature Tem.

In the exemplary illustration, as described above, the amount of time between the point in time when the exhaust gas temperature reaches the first predetermined temperature Tmax to time when the temperature of the exhaust manifold reaches the maximum allowable heat resistance temperature varies due to the engine's operating region immediately before the fuel increment. For this reason, the delay time set in S16 is corrected in response to the operating region that existed immediately before the fuel increment.

It should be recognized that a portion of the heat absorbed by the manifold from the exhaust gas is radiated into the air surrounding the manifold. Thus, in the present embodiment, the delay time set in S16 is additionally corrected for the amount of heat radiated from the exhaust manifold. This correction of the delay time is performed in S17 to S19.

First, in S17, the operational region correction coefficient is read. As described above in S6, the operational region correction coefficient is a coefficient for setting the delay time such that higher loads and speeds immediately before a fuel increment result in shorter delay times. Further, in order to correct the delay time due to the heat radiated from the exhaust manifold, the outside air temperature Tout and the vehicle speed Vsp are read.

In S18 (described in detail below), an outside air temperature correction coefficient DLYHOS#, which is set in response to the outside air temperature Tout, and a vehicle speed correction coefficient FUEHOS#, which is set in response to the vehicle speed Vsp, are multiplied by the delay time set in S16 to yield a final delay time. A detailed description of the outside air temperature correction coefficient DLYHOS# set in response to the outside air temperature Tout and the vehicle speed correction coefficient FUEHOS# set in response to the vehicle speed Vsp follows.

When the outside air temperature is lower than a predetermined room temperature range, there is a greater amount of time between the time when the exhaust gas temperature reaches the first predetermined temperature Tmax to the time when an actual exhaust gas manifold temperature reaches the allowable heat resistance temperature due to the amount of heat discharged from the exhaust manifold to the atmosphere. The outside air temperature correction coefficient DLYHOS# corrects the optimum delay time based on any variation in the outside air temperature.

The outside air temperature correction coefficient DLYHOS# is set to 1, for example, when the outside air temperature Tout is in a room temperature range (0° C. to 30° C.). When the outside air temperature Tout is higher than the room temperature range, the amount of heat radiated from the exhaust manifold is less than the amount radiated in the room temperature range. Therefore, DLYHOS# is set to a value of 1 or less in order to reduce the delay time. Similarly, when the outside air temperature Tout is lower than the room temperature area, the amount of heat radiated from the exhaust manifold is greater than the amount radiated in the room temperature range. Therefore, DLYHOS# is set to a value of 1 or more in order to increase the delay time.

The vehicle speed correction coefficient FUEHOS# similarly corrects the optimum delay time in response to the amount of heat radiated from the exhaust manifold. The vehicle speed correction coefficient FUEHOS# increases the delay period at higher speeds because the amount heat dissipation is large when the vehicle speed is high. On the other hand, the delay period is reduced at low speeds because the amount of heat dissipation is small. Specifically, the vehicle speed correction coefficient FUEHOS# is 1 when the vehicle speed is zero, and increases to values greater than 1 as the vehicle speed becomes higher. Accordingly, an optimum delay period before a fuel increment can be calculated based on the operational state immediately before the fuel increment and the amount heat dissipation from the exhaust manifold (outside air temperature, vehicle speed, and the like) after the point in time when a fuel increment becomes necessary.

Figure 8:
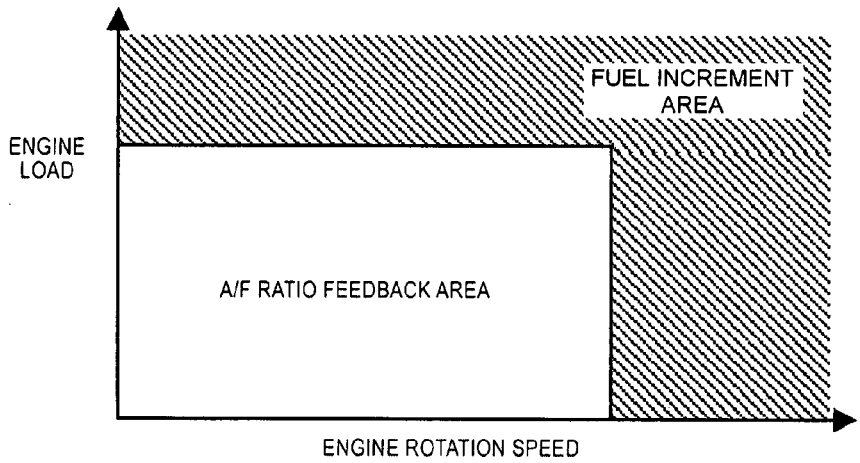
FIG. 8 is a chart of engine rotational speed and load displaying the A/F Ratio Feedback Area and the Fuel Increment Area.

Next, in S19, a fuel increment correction coefficient Kfuel is set in fuel increment area. As shown in the map of FIG. 8, high loads and high speeds define an operating region of the engine in which A/F ratio feedback control is stopped in order to implement a fuel increment. The fuel increment correction coefficient Kfuel is set to larger values for higher and greater speeds and loads. The fuel increment correction coefficient Kfuel is set to 0 in A/F ratio feedback area.

As described above, at higher vehicle speeds Vsp a greater amount of heat is radiated from the exhaust manifold. For this reason, even when the fuel increment correction coefficient Kfuel set according to the map of FIG. 8 is decreased, the temperature of the exhaust manifold can still be sufficiently decreased. Thus, in the process of S19, the fuel increment correction coefficient Kfuel that becomes the base value is corrected by multiplying it with the vehicle speed correction coefficient VSPHOS#. As described above, higher the vehicle speeds Vsp result in a smaller vehicle speed correction coefficient VSPHOS# being set, while lower vehicle speeds Vsp result in a larger vehicle speed correction coefficient VSPHOS# being set. So the resulting fuel increment correction coefficient Kfuel is smaller at high speeds and larger at low speeds. Similarly, the fuel increment correction coefficient Kfuel may be compensated in response to the outside air temperature Tout.

In S20, it is determined whether or not the delay time set in S18 has elapsed. If it has elapsed, the process proceeds to the next step S21. In S21, the fuel increment is started in response to the fuel increment correction coefficient Kfuel set in S19. Specifically, the A/F ratio feedback control is stopped and the A/F ratio feedback correction coefficient $\alpha$ is fixed to a reference value or a previous value. As a consequence, the fuel injection amount Ti is corrected and increased to enrich the A/F ratio in order to decrease the exhaust gas temperature.

In S22, the exhaust gas temperature Te, which was last estimated through the exhaust gas temperature estimation routine of FIG. 3, is estimated again in order to ensure that there has been a decrease in the exhaust gas temperature. In S23, the exhaust gas temperature Te is compared with Tperm to determine whether or not $Te \leqq Tperm$. Tperm is a second predetermined temperature, a fuel increment completion temperature, which is lower than the first predetermined temperature Tmax.

If Te is greater than Tperm, the process returns to S22 to continue the fuel increment. Similarly, if Te is less than or equal to Tperm, the process proceeds to S24 to end the fuel increment. Thus, the fuel increment continues until the exhaust gas temperature decreases to a value less than or equal to the second predetermined temperature Tperm which is lower than the first predetermined temperature Tmax, so that the exhaust gas temperature can be decreased reliably.

S15 corresponds to an exhaust gas temperature change ratio calculation means, S16 to S18 correspond to a delay time set means, and S21 to S24 correspond to a fuel increment means.

As described above, even when there is a drastic increase in the exhaust gas temperature as shown in FIG. 5, there is a time lag before the exhaust gas temperature reaches the maximum allowable heat resistance temperature Tem of the exhaust manifold. When a fuel increment is employed as a means for reducing the exhaust gas temperature, fuel efficiency can be improved by delaying the fuel increment for a calculated period of time. The calculated delay period is based on the exhaust gas temperature change ratio (internal resistance change ratio) $\Delta Te$. Therefore, the timing of fuel increments can be set precisely to reliably maintain the manifold temperature to the maximum allowable heat resistance temperature Tem or lower.

As a means for monitoring the exhaust gas temperature precisely, an A/F ratio sensor is employed. This A/F ratio sensor estimates the exhaust gas temperature through its internal resistance (element temperature) so that monitoring can be performed relatively correctly. Of course, an exhaust gas temperature sensor may be attached to an exhaust system to detect the exhaust gas temperature directly.

Further, the present illustration is constructed such that means (S6) for setting the correction coefficient K1 in response to the engine's operational region is provided so that the exhaust gas temperature estimated in response to the internal resistance of the A/F ratio sensor element is corrected by the correction coefficient K1 at a transition time. Similarly means (S7) for setting the correction coefficient K2 in response to the exhaust gas flow rate is provided so that the exhaust gas temperature estimated in response to the internal resistance of the A/F ratio sensor is corrected by the correction coefficient K2 at a transition time. With this configuration, the exhaust gas temperature can be estimated precisely even when there is a time lag is due to heat mass of the sensor element, which can occur during a transition time.

Further, according to one illustrative approach, a predetermined voltage for measuring the internal resistance is applied to the A/F ratio sensor element to read the sensor output. In response to this output, the internal resistance of the A/F ratio sensor element is measured. Consequently, the internal resistance can be measured precisely, whereby the accuracy of the exhaust gas temperature estimate (element temperature) can be improved.

The delay time is corrected for any heat radiated from the exhaust manifold in one embodiment while other embodiments may omit this step. An estimated value of the exhaust gas temperature or the first predetermined temperature may be corrected.

Although the operational state immediately before the fuel increment area is stored to correct the delay time in one embodiment, other embodiments may omit this step. Alternatively, the length of delay before a fuel increment can be corrected by monitoring the operational state immediately before the fuel increment for a predetermined period of time in order to estimate a temperature difference between the exhaust gas temperature and the exhaust manifold.

For example, even when the exhaust gas temperature reaches the first predetermined temperature Tmax as the engine transitions from an idling operating region to a middle load region, the temperature increase of the exhaust manifold is slow due to the heat capacity of the exhaust manifold.

Further, assume that a driver continues to accelerate the vehicle such that the operational state enters the fuel increment region. In this case, the exhaust gas temperature and the temperature of the exhaust manifold before the engine reaches the fuel increment region are not in an equilibrium condition, that is in a state in which although the exhaust gas temperature is higher, the temperature of the exhaust manifold is lower compared to that. Thus, it is desirable to set the delay period before a fuel increment to a greater length than that shown in FIG. 7.

In such a situation, the operational state immediately before the fuel increment area is monitored for a predetermined period of time as described above. Thereby, the temperature difference between the exhaust gas temperature and the temperature of the exhaust manifold is estimated, so that an optimum delay time can be set even if the exhaust gas temperature and the temperature of the exhaust manifold are different from each other before the fuel increment area.

Although the discussion above generally relates to protecting the exhaust manifold, the disclosed systems and methods would be equally effective in protecting other exhaust system components such as an exhaust gas purification catalyst.

The preceding description has been presented only to illustrate and describe exemplary embodiments of the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A method for protecting an exhaust system of an internal combustion engine, comprising:

estimating an exhaust gas temperature of exhaust gas discharged from the internal combustion engine;

calculating a change ratio of the exhaust gas temperature;

setting a delay period based on the change ratio of the exhaust gas temperature when the exhaust gas temperature reaches a first predetermined temperature; and increasing a fuel feed amount to the engine after the delay period elapsed.

2. The method for protecting an exhaust system of an internal combustion engine according to claim 1, wherein setting sets the delay period such that the larger the change ratio, the shorter the delay period.

3. The method for protecting an exhaust system of an internal combustion engine according to claim 1, further including an air/fuel ratio sensor arranged in the exhaust system for detecting an air/fuel ratio of the exhaust gas discharged from the internal combustion engine and wherein the step of estimating estimates the exhaust gas temperature based on an internal resistance of the air/fuel ratio sensor.

4. The method for protecting an exhaust system of an internal combustion engine according to claim 3, further including:

determining whether the internal combustion engine driving condition is a transition condition;

calculating a temperature correction coefficient based on at least an operational region of the engine; and correcting the exhaust gas temperature with the temperature correction coefficient if the internal combustion engine driving condition is the transition condition.

5. The method for protecting an exhaust system of an internal combustion engine according to claim 3, further including:

determining whether the internal combustion engine driving condition is a transition condition;

calculating a temperature correction coefficient based on at least an exhaust gas flow rate; and correcting the exhaust gas temperature with the temperature correction coefficient if the internal combustion engine driving condition is the transition condition.

6. The method for protecting an exhaust system of an internal combustion engine according to claim 3, wherein the step of estimating an exhaust gas temperature includes:

applying a predetermined measuring voltage to the air/fuel ratio sensor;

measuring an output voltage of the air/fuel ratio sensor; and calculating the internal resistance of the air/fuel ratio sensor based on the output voltage.

7. The method for protecting an exhaust system of an internal combustion engine according to claim 1, further including continuing the fuel feed amount until the exhaust gas temperature decreases to a second predetermined temperature that is lower than the first predetermined temperature.

8. The method for protecting an exhaust system of an internal combustion engine according to claim 1, further including an exhaust gas temperature sensor within the exhaust system and wherein estimating an exhaust gas temperature includes the sub-step of directly measuring the exhaust gas temperature using the exhaust gas temperature sensor.

9. The method for protecting an exhaust system of an internal combustion engine according to claim 1, further including:

estimating an amount of heat radiated from an exhaust system component; and, correcting the delay period based on the amount of heath radiated from the exhaust system component.

10. The method for protecting an exhaust system of an internal combustion engine according to claim 9, wherein estimating an amount of heat radiated from and exhaust system component includes:

detecting a vehicle speed;

detecting an outside air temperature; and, estimating the amount of heat radiated from the exhaust system component on the vehicle speed and the outside air temperature.

11. The method for protecting an exhaust system of an internal combustion engine according to claim 1 further including:

determining that an engine state needs to transition to a fuel increment region;

storing an operational history of the engine state;

transitioning the engine state to the fuel increment region; and correcting the delay period based on the operational history.

12. The method for protecting an exhaust system of an internal combustion engine according to claim 1 further including:

reading a vehicle speed; and adjusting the fuel feed amount based on the vehicle speed.

13. The method for protecting an exhaust system of an internal combustion engine according to claim 1 further including:

reading an outside air temperature; and adjusting the fuel feed amount based on the outside air temperature.

14. An exhaust system protecting device for an internal combustion engine, comprising:

exhaust gas temperature estimation means for estimating an exhaust gas temperature of exhaust gas discharged from the internal combustion engine;

exhaust gas temperature change ratio calculation means for calculating a change ratio of the exhaust gas temperature estimated by the exhaust gas temperature estimation means;

delay time set means for setting a delay time until a fuel increment in response to the change ratio of the exhaust gas temperature calculated by the exhaust gas temperature change ratio calculation means when the exhaust gas temperature estimated by the exhaust gas temperature estimation means reaches a first predetermined temperature; and fuel increment means for increasing a fuel feed amount to the engine after the delay time set by the delay time set means.

15. The exhaust system protecting device for the internal combustion engine according to claim 14, wherein the delay time set means sets the delay time in such a manner that the larger the change ratio, the shorter the delay time.

16. The exhaust system protecting device for the internal combustion engine according claim 14, wherein the fuel increment means implements the fuel increment until the exhaust gas temperature estimated by the exhaust gas temperature estimation means decreases to a level less than or equal to a second predetermined temperature which is lower than the first predetermined temperature.

* * * * *